United States Patent [19]

Greenberg

[11] 4,279,400

[45] Jul. 21, 1981

[54] HOT TOP FOR INGOT MOLD

[75] Inventor: Lawrence A. Greenberg, Allentown, Pa.

[73] Assignee: Bethlehem Steel Corporation, Bethlehem, Pa.

[21] Appl. No.: 51,256

[22] Filed: Jun. 22, 1979

[51] Int. Cl.[3] ..... B22D 7/10

[52] U.S. Cl. ..... 249/106; 249/201

[58] Field of Search ..... 249/106, 197–201

[56] References Cited

U.S. PATENT DOCUMENTS

| | | | |
|---|---|---|---|
| 1,207,645 | 12/1916 | Slick | 249/201 |
| 2,846,741 | 8/1958 | Whitacre | 249/201 |
| 3,437,308 | 4/1969 | Thiem et al. | 249/201 |

*Primary Examiner*—Robert D. Baldwin

*Attorney, Agent, or Firm*—Joseph J. O'Keefe; John I. Iverson

[57] ABSTRACT

A hot top for the casting of ingots, especially large size rectangular steel ingots having a thickness of at least 28 inches and a width greater than the thickness but no greater than 36 inches. The hot top has an octagonal refractory lined cavity with the lengths of the four corner sides being substantially equal to each other and greater in length than any of the other four sides, but not greater than 1.2 times the length of the longest of the other four sides.

3 Claims, 3 Drawing Figures

HOT TOP FOR INGOT MOLD

BACKGROUND OF THE INVENTION

This invention relates to a hot top for ingot molds. It relates particularly to a superimposed hot top designed to rest on top of an ingot mold.

The typical superimposed hot top is comprised of an iron or steel casting lined with replaceable refractory material and provided with a tapering upwardly central opening or cavity. Molten metal is poured through such opening into the ingot mold positioned underneath the hot top. Pouring of the molten metal is continued until the level of the molten metal rises to a predetermined height in the hot top cavity to form a reservoir of molten metal that will feed metal downwardly into the ingot to overcome shrinkage during the solidification of the ingot.

The hot top must be designed not only to provide a sufficient reservoir of molten metal to fill the shrinkage cavity in the ingot, but also must reduce the heat losses from such reservoir to insure that the molten metal in the hot top reservoir remains molten during the solidification of the ingot.

After the ingot has solidified, the hot top casing is removed and the ingot is stripped from the ingot mold. The solidified metal that remained in the hot top, called the "sinkhead" is then cropped from the ingot and scrapped after the ingot is rolled. The scrapped sinkhead is thus unusable metal and with many ingots can amount to as much as 13-15 percent of the ingot volume.

In the past, there have been many attempts to reduce the size of the sinkhead to be scrapped by specially designed ingot molds and hot tops. However, such attempts have frequently resulted in ingots of poor quality, problems in rolling the ingots, or been restricted to relatively small size ingots.

One such specially designed hot top is that disclosed in U.S. Pat. No. 2,846,741, issued in 1958 to Whitacre. Whitacre designed the hot top cavity in the form of a substantially circular hollow cylinder to reduce the volume of molten metal in the hot top reservoir and to reduce heat losses. Whitacre suggests that the scrapped sinkhead will amount to 10 percent or less of the volume of the ingot. However, Whitacre's hot top design will likely produce problems during the stripping and the rolling of the ingot.

U.S. Pat. No. 1,207,645, issued in 1916 to Slick, and U.S. Pat. No. 3,437,308, issued in 1969 to Thiem et al, each show attempts to use an eight sided hot top cavity to reduce the reservoir volume and heat losses during solidification. To date, there has been no usage of such hot tops in the steel industry except for very small ingots.

SUMMARY OF THE INVENTION

It is therefore an object of this invention to provide a hot top for relatively large ingots that reduces the size of the scrapped sinkhead and reduces heat losses during the solidification of the ingot.

It is a further object of this invention to provide a hot top which is easily adapted to conventional large size rectangular ingot molds.

It is a still further object of this invention to provide a hot top for an ingot mold that will produce an ingot of sound internal quality that can be easily rolled into billets or other shapes.

I have discovered the foregoing objects can be attained by a hot top having a critically dimensioned eight sided cavity mounted on the top surface of a rectangular ingot mold.

DESCRIPTION OF PREFERRED EMBODIMENT

Figure 1:
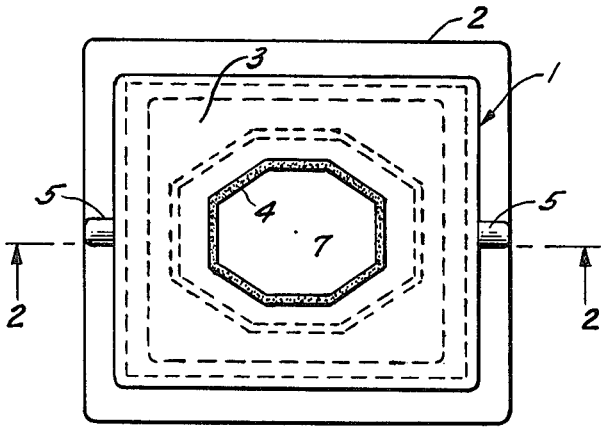
FIG. 1 is a plan view of a hot top of this invention.
Figure 2:
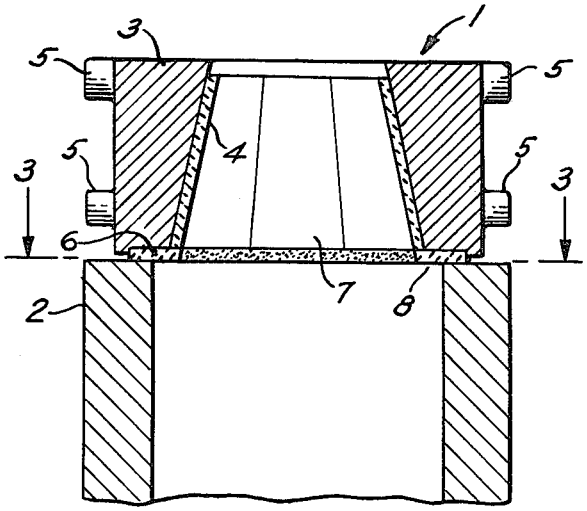
FIG. 2 is a partial sectional elevation view of the hot top of this invention and an ingot mold taken along the longitudinal plane 2—2 of FIG. 1.

Referring to the Figures and in particular to FIGS. 1 and 2, which illustrate a preferred embodiment of the hot top 1 of this invention. The hot top 1 of this invention is especially suitable for rectangular ingot molds for casting steel ingots whose thickness is at least 28 inches (71.1 cm.) and whose width is greater than 28 inches (71.1 cm.) but not greater than 36 inches (91.4 cm.). Rectangular ingots of this size are commonly produced in the steel industry for rolling into a variety of steel products.

Hot top 1 is comprised of a steel or iron casing 3 which is lined with a replaceable refractory board material 4. The hot top casing 3 is provided with lifting lugs 5. The hot top 1 shown in FIGS. 1 and 2 is of the superimposed type characterized by the fact that such hot tops rest on the top surface of the ingot mold 2. A refractory sealing ring or gasket 6 is placed between the top surface of the ingot mold 2 and the bottom surface of hot top 1 to compensate for any irregularities in these surfaces and to prevent the leakage of molten metal into the space between these surfaces. The refractory sealing ring 6 as illustrated in FIG. 2 forms a flat transverse shoulder 8 along plane 3—3. Both the gasket 6 and the flat transverse shoulder result in a more effective solidification of the ingot.

Hot top 1 is provided with an upwardly tapering central opening or cavity 7 which contains the reservoir of molten metal during the solidification of the ingot. The dimensions of this cavity 7 are critical for the production of sound, quality ingots which can be further handled and processed without difficulty and with a maximum yield.

Figure 3:
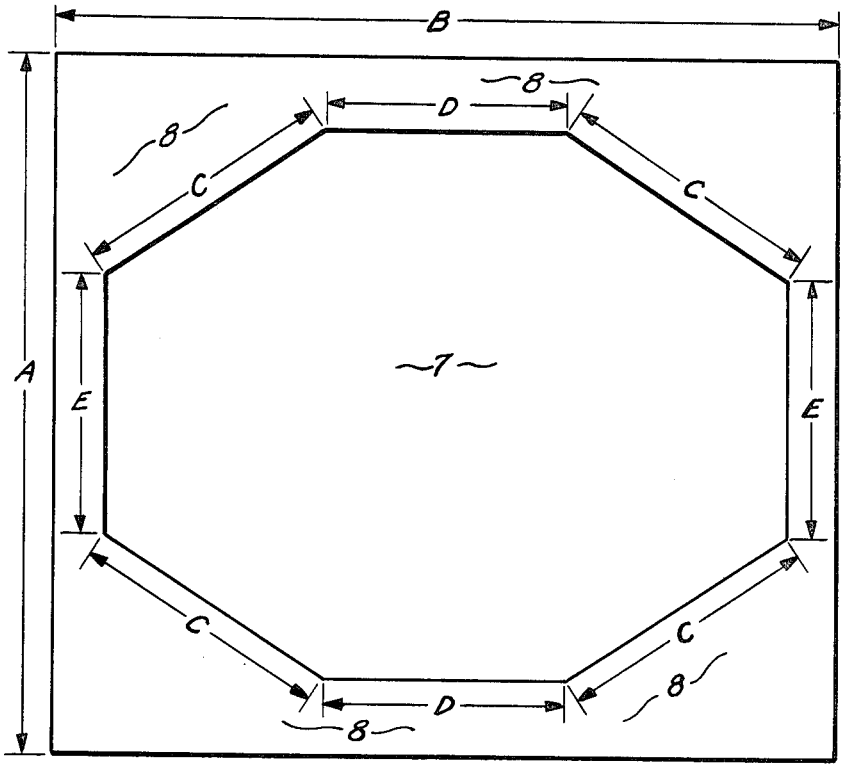
FIG. 3 is a sectional plan view of a solidified ingot cast using the hot top of this invention which has been cut along the transverse plane 3—3 of FIG. 2 to illustrate the dimensional relationships of the hot top of this invention.

As best illustrated in FIG. 1, the cavity has the shape of an eight sided polygon. FIG. 3, which is a sectional plan view of a solidified ingot cast using the hot top of this invention, which has been cut along the transverse plane 3—3 of FIG. 2, and best illustrates the dimensions of the cavity 7 of hot top 1 of this invention.

Dimension A indicates the thickness of the rectangular ingot, which for this invention is at least 28 inches (71.1 cm.). Dimension B indicates the width of the ingot which is greater than dimension A, but not greater than 36 inches (91.4 cm.).

Dimension C on FIG. 3 indicates the length of the four corners of the bottom of the resulting sinkhead that remains on the ingot when it has been stripped and cropped and corresponds to corresponding wall dimensions of the cavity 7 of the hot top 1. As shown in FIG. 3, all four corners are of substantially the same length C.

Dimension D indicates the length of the two equal sides of the sinkhead which are parallel to the long sides B of the ingot. Dimension E indicates the length of the two equal sides of the sinkhead which are parallel to the shorter sides A of the ingot.

It has been discovered that in order to produce a sound, quality rectangular ingot in the size range discussed above, the hot top cavity 7 must have the corner side lengths C greater in length than either the sides D or E, but of a length not greater than 1.2 times the length of sides D, which are the longest of the eight sides of cavity 7.

Since rectangular ingots are normally cast using hot tops having a corresponding rectangular four sided cavity, the hot top 1 of my invention which is eight sided, will save the metal that previously would be required to fill the corners of the rectangular cavity. For the ingots of the size discussed above, this amount of metal that can be saved may be as much as 2–3 percent of the volume of the ingot. This savings results in substantial savings to a large volume steelmaker who casts many thousands of ingots monthly.

It has been observed in following the rolling of the ingots produced through the hot top of this invention that such ingots do not present rolling problems. It was feared that during the initial rolling of such ingots, i.e., blooming, that since the corner material on the remaining sinkhead was removed, a large portion of the corner of the upper portion of the ingot would roll over the missing sinkhead corner and produce a portion of the rolled steel product that was lapped and therefore unacceptable. By adhering to the dimensional relationships set forth above, this will not be the case.

Finally, the removal of the corners for the conventional rectangular hot top cavity has not affected the hot top function, i.e., keeping a reservoir of molten metal available during the solidification of the ingot.

A specific example of the hot top of this invention for the casting of a 31 inch (78.74 cm.) by 35 inch (88.90 cm.) ingot is:

| | | | |
|---|---|---|---|
| Dimensions | A - 31 | inches | (78.74 cm.) |
| | B - 35 | " | (88.90 cm.) |
| | C - 11.54 | " | (29.31 cm.) |
| | D - 10.67 | " | (27.10 cm.) |
| | E - 11.43 | " | (29.03 cm.) |

The sides C and D are tapered inwardly towards the top by the hot top cavity 7 at the rate of 0.21 inches per inch to a height of 18.25 inches (46.4 cm.) above plane 3—3. The sides E are tapered inwardly towards the top of the hot top cavity 7 at the rate of 0.06 inches per inch to a height of 18.25 inches (46.4 cm.) above plane 3—3.

I claim:

1. A hot top in combination with a rectangular ingot mold, said mold capable of producing a rectangular ingot having a thickness of at least 28 inches and a width greater than said thickness but no greater than 36 inches, said hot top having an octagonal refractory lined cavity, the lengths of the four corner sides of said cavity at the bottom of said hot top and measured in a transverse plane being substantially equal to each other, said corner sides being greater in length than any of the other four sides of said hot top measured in said transverse plane, but not greater than 1.2 times the length of the longest of said other four sides.

2. The combination of claim 1 in which the hot top is superimposed upon and adapted to rest on the top surface of said ingot mold.

3. The combination of claim 2 in which a refractory sealing ring is positioned between said hot top and the top surface of said ingot mold to produce a flat transverse shoulder along said transverse plane.

* * * * *